United States Patent [19]

Hirose

[11] 4,287,804

[45] Sep. 8, 1981

[54] ELECTRONIC MUSICAL INSTRUMENT WITH TIMBRE SELECTION

[75] Inventor: Yasunori Hirose, Hamamatsu, Japan

[73] Assignee: Nippon Gakki Seizo Kabushiki Kaisha, Shizuoka, Japan

[21] Appl. No.: 167,121

[22] Filed: Jul. 9, 1980

[51] Int. Cl.[3] ..... G10H 1/02; G10H 1/06

[52] U.S. Cl. ..... 84/1.19; 84/1.1; 84/1.24; 84/1.25; 84/1.27; 84/DIG. 4

[58] Field of Search ..... 84/1.09–1.13, 84/1.19–1.21, 1.24–1.27, DIG. 4

[56] References Cited

U.S. PATENT DOCUMENTS

| | | | |
|---|---|---|---|
| 3,590,133 | 6/1971 | Schwartz et al. | 84/1.24 |
| 3,767,834 | 10/1973 | Hebelsen et al. | 84/1.19 |
| 3,948,139 | 4/1976 | Melcher et al. | 84/1.19 |
| 4,050,343 | 9/1977 | Moog | 84/1.24 X |
| 4,176,577 | 12/1979 | Yamada et al. | 84/1.19 X |

*Primary Examiner*—S. J. Witkowski

*Attorney, Agent, or Firm*—Koda and Androlia

[57] ABSTRACT

A timbre-select type electronic musical instrument in which the application of a sound effect unsuitable for the selected timbre is automatically blocked. This instrument includes means for detecting that a certain timbre is selected and means responsive to the signal from said detecting means for preventing the unsuitable effect for the timbre from being applied to a sound.

9 Claims, 2 Drawing Figures

SELECTOR CIRCUIT
SELECTOR CIRCUIT
ENSEMBLE EFFECT CIRCUIT
TREMOLO EFFECT CIRCUIT
INHIBIT GATE
FILTER CIRCUIT
FILTER CIRCUIT
FILTER CIRCUIT
FILTER CIRCUIT
CONTROL SIGNAL WAVE SHAPING CIRCUIT
TOUCH SENSOR CIRCUIT
GLIDE EFFECT CIRCUIT
VIBRATO EFFECT CIRCUIT
VCA
KEYER
KEY SWITCH CIRCUIT
KEYBOARD
MAIN OSC
FREQ. DIV.

ELECTRONIC MUSICAL INSTRUMENT WITH TIMBRE SELECTION

BACKGROUND OF THE INVENTION

1. Field of the Invention

This invention relates to an electronic musical instrument capable of selectively producing sound with a desired timbre and more particularly to an electronic musical instrument in which sound effects unsuitable for the selected timbre are automatically blocked from being produced.

2. Prior Art

In the conventional timbre-select type musical instruments, a vibrato effect can be applied, for example, to the sound of a piano, which is undesirable in performance because the natural sound of a piano does not vibrate. With this kind of electronic musical instrument there is a possibility of the performer misoperating the vibrato effect application circuit, giving undesired vibrato effect to the piano sound. To prevent this, the performer must, every time he selects a specific timbre such as that of the piano, check the instrument to see whether or not undesired effect is added. This causes a great nuisance to the performer.

SUMMARY OF THE INVENTION

The object of this invention is to provide a novel electronic musical instrument in with the operation for producing desired sound effect on the selected timbre is simplified.

One of the features of this invention is that a sound effect that is not suitable for the tone selected is automatically blocked from being applied to that tone. For this purpose, the timbre-select type electronic musical instrument has a means for detecting that a certain timbre has been selected and a means responsive to the signal from the detecting means for preventing the effects unsuitable for the timbre selected from being applied to the sound. Another feature of this invention is that this electronic musical instrument is provided with a means responsive to the signal from the detecting means for indicating the sound effect that is suitable for the selected tone. Thus, the first advantage of this invention is that the performer does not have to carry out special operation nor pay attention to the condition of the instrument in order to prevent an undesired effect from being produced on the sound because of unsuitable sound effects with respect to the timbre selected are automatically blocked. The second advantage of this invention is that a player can easily perform or do exercises by utilizing the indicators showing the suitable effects for the tone selected.

BRIEF DESCRIPTION OF THE DRAWINGS

The above mentioned and other objects, features and advantages of the present invention will become more apparent with reference to the following description taken in conjunction with the accompanying drawings in which.

DETAILED DESCRIPTION OF THE INVENTION

Figure 1:
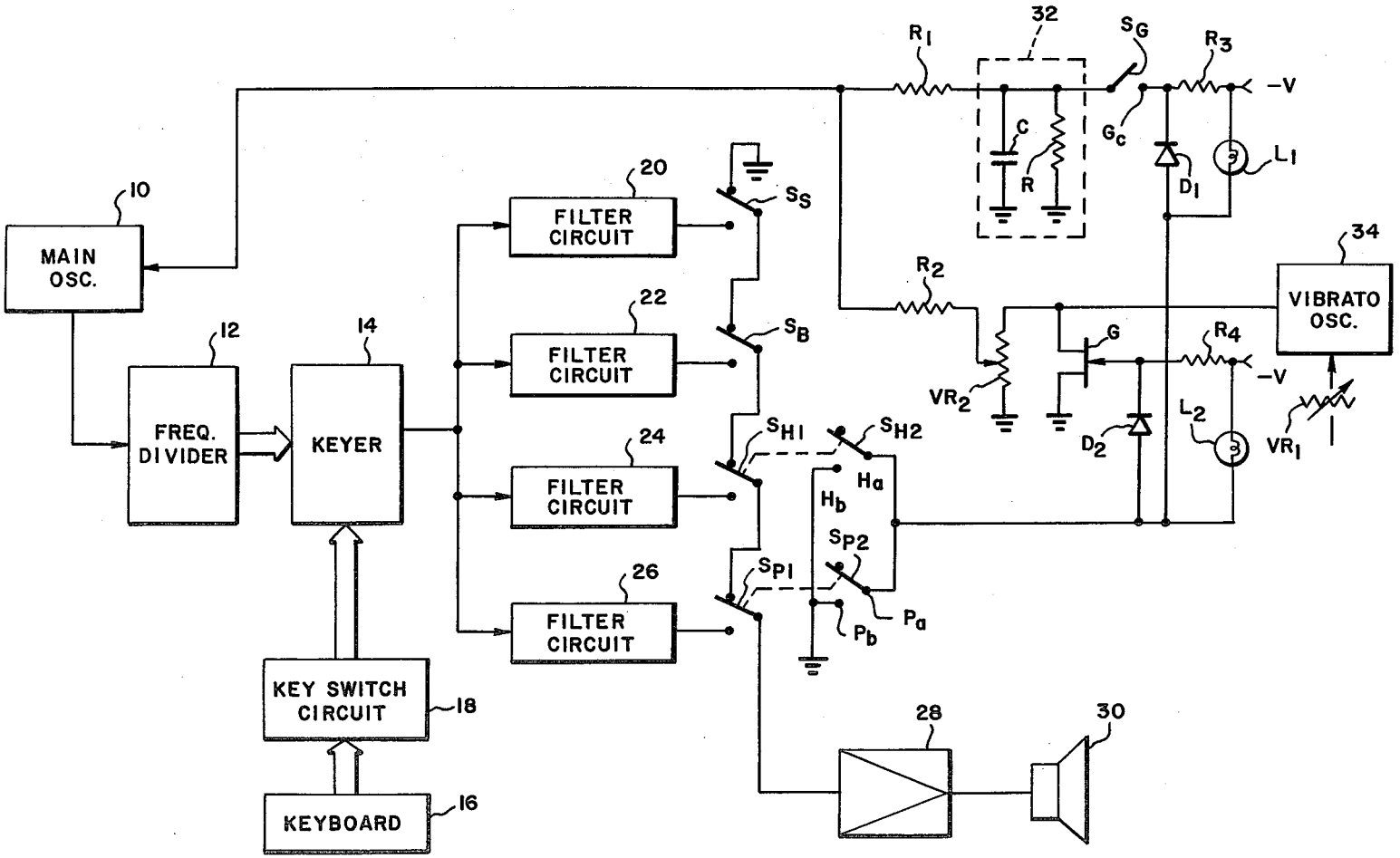
FIG. 1 is a functional block diagram of an electronic musical instrument embodying the present invention.

Referring now to FIG. 1, the timbre-select type electronic musical instrument of this invention comprises a main oscillator 10 for generating rectangular wave signals of a frequency sufficiently higher than the highest sound in the top octave among a number of sounds to be generated and shaped, a frequency divider 12 for reducing the frequency of the rectangular wave signals from the main oscillator 10 to generate sound-source signals for entire range of sounds to be generated, a keyer 14 for selectively keying the sound-source signals from the frequency divider 12, a keyboard 16 with a number of keys to be depressed, and a key switch circuit 18 for supplying to the keyer 14 a signal representing the key depressed.

The keyer 14 selects the sound-source signal according to the signal from the key switch circuit 18 and supplies the keyed output signal to four timbre filter circuits 20, 22, 24 and 26. The filter circuit 20 has a timbre filter whose frequency characteristics are so determined as to emphasize the timbre of string instruments. Other filter circuits 22, 24, and 26 also have timbre filters with frequency characteristics that emphasize the timbres of metal wind instruments, harpsichords and pianos, respectively. Thus, these timbre filter circuits 20, 22, 24 and 26 output sound signals with timbres of string instruments, metal wind instruments, harpsichords and pianos.

Provided on the output side of the timbre filter circuits 20, 22, 24 and 26 are timbre selection switches $S_S$, $S_B$, $S_{H1}$, and $S_{P1}$, which are arranged so that the sound signals are given priorities in the order of piano, harpsichords, metal wind instruments and string instruments, and are supplied to an output amplifier 28. When, for example, the switch $S_{P1}$ is closed to the sound signal of a piano, other switches $S_S$, $S_B$, and $S_{H1}$ are rendered ineffective so that only the sound signal of the piano is supplied to the output amplifier 28.

The sound signal fed to the output amplifier 28 is amplified and then supplied to a loudspeaker 30 which makes it audible.

The main oscillator 10 receives a glide signal and a vibrato signal. The glide signal is obtained by integrating the on-off signal of the glide effect selection switch $S_G$ by the R-C integrator 32 and is supplied to the oscillator 10 through a resistor $R_1$. The vibrato signal whose frequency (vibrato speed) is controlled by a rheostat or variable resistor $VR_1$ is supplied from a vibrato oscillator 34 to the oscillator 10 through a vibrato depth adjusting rheostat $VR_2$ and the resistor $R_2$. In response to the glide signal and/or the vibrato signal, the main oscillator 10 varies the output frequency to produce the glide effect and/or the vibrato effect.

These glide and vibrato effects, however, are prevented from being applied to the sounds of harpsichords and pianos by the following construction. That is, the harpsichord timbre selection switch $S_{H1}$ and the piano timbre selection switch $S_{P1}$ are provided with effect blocking switches $S_{H2}$ and $S_{P2}$, respectively, whose stationary contacts Hb and Pb are grounded and the moving contacts Ha and Pa are connected to the anodes of diodes $D_1$ and $D_2$, respectively. The cathode of the diode $D_1$ is connected to a stationary contact Gc of the glide effect selection switch $S_G$ which in turn is connected to the potential source $-V$ through a resistor $R_3$. The cathode of the diode $D_2$ is connected to the control input terminal of the gate G which is connected to the potential source $-V$ through a resistor $R_4$. The gate G is connected between the output terminal of the vibrato oscillator 34 and the ground.

When the timbres of harpsichord and piano are not selected and the switches $S_{H2}$ and $S_{P2}$ are open as shown, the potential $-V$ is applied to one stationary contact Gc of the glide effect selection switch $S_G$ and to a control input terminal of the gate G so that the gate G is turned off. In this condition the glide effect and/or the vibrato effect can be applied. When on the other hand, the timbre of the harpsichord or piano is selected and the switch $S_{H2}$ or $S_{P2}$ is closed, a ground potential is supplied to the stationary contact Gc of the glide effect selection switch $S_G$ and to the control input terminal of the gate G through the diodes $D_1$ and $D_2$. In this condition, the glide signal is not generated even when the glide effect selection switch $S_G$ is closed, and because the gate G is turned on, the output potential of the vibrato oscillator 34 becomes ground potential through the gate G and not supplied to the main oscillator 10. As a result, the application of the glide effect and/or the vibrato effect is blocked.

A lamp $L_1$ connected in parallel with the resistor $R_3$ and the diode $D_1$ lights when the glide effect is blocked, and a lamp $L_2$ connected in parallel with the resistor $R_4$ and the diode $D_2$ lights when the vibrato effect is blocked.

With the electronic musical instrument having the construction shown in FIG. 1, the performer can play freely and smoothly because when the timbre of the piano or harpsichord is selected the glide effect and vibrato effect are automatically blocked. Where a portamento effect circuit, though not shown in FIG. 1, is provided, it is desirable that the portamento effect be automatically blocked when the timbre of the piano or harpsichord is selected.

Figure 2:
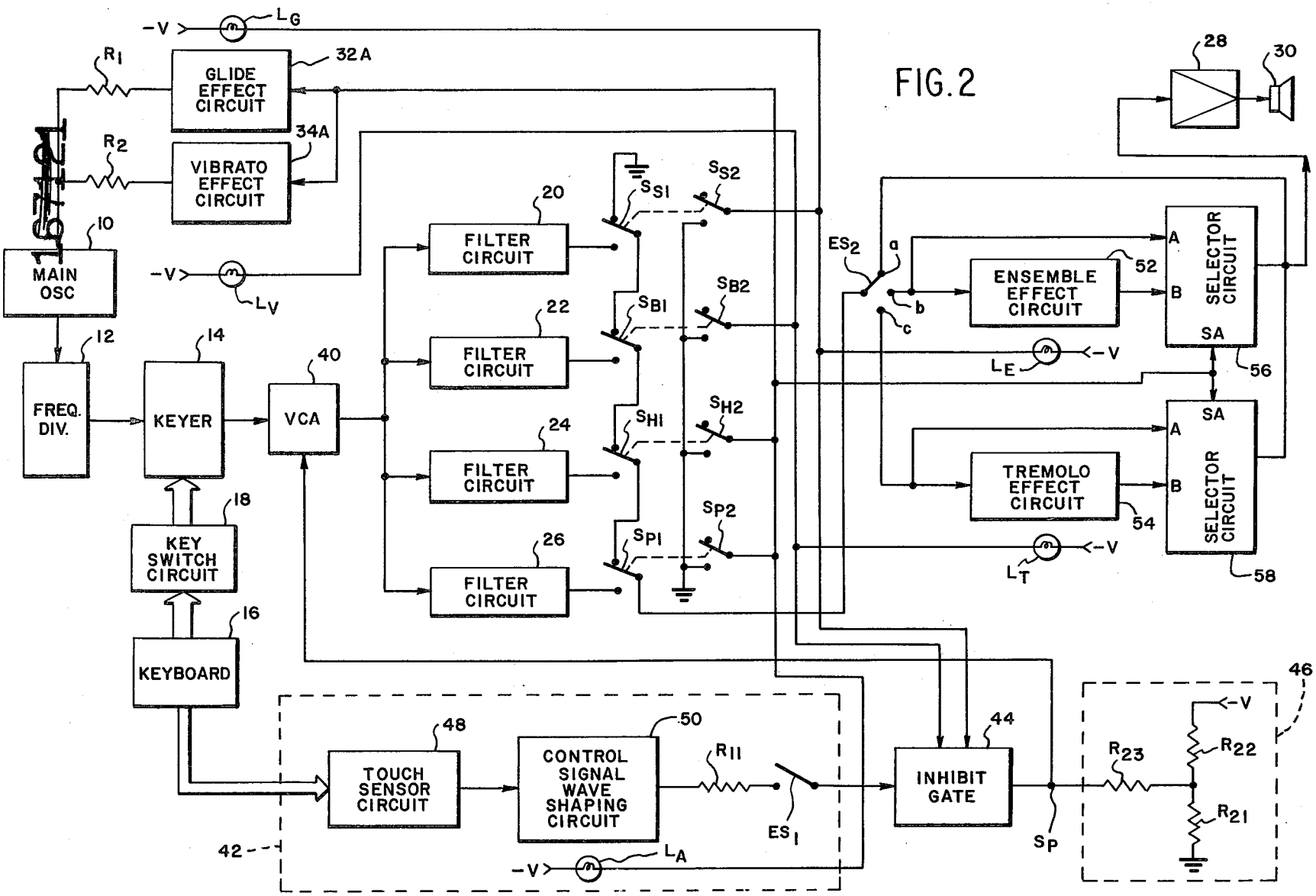
FIG. 2 is a functional block diagram showing another embodiment of the present invention.

FIG. 2 shows another embodiment of this invention. Components that are identical with those in FIG. 1 are given the same reference numerals, and their explanation is omitted here. The features of the second embodiment can be summarized as follows:

(1) For the timbre of stringed instruments a touch response effect is blocked and instead an ensemble effect and a glide effect are produced.

(2) For the timbre of metal wind instruments a touch response effect is blocked and instead the vibrato effect and the tremolo effect are produced.

(3) For the timbres of a harpsicord or piano, such effects as glide, vibrato, ensemble and tremolo effects are blocked, and instead a touch response effect is produced.

In FIG. 2, 32A and 34A represent a glide effect circuit and a vibrato effect circuit, both being similar to those shown in FIG. 1. These circuits 32A and 34A are disabled by the switch $S_{H2}$ or $S_{P2}$ that closes when a timbre of a harpsichord or piano is selected. The glide effect circuit 32A is provided with a lamp $L_G$. The lamp $L_G$ lights up when a switch $S_{S2}$ linked with a stringed instrument timbre selection switch $S_{S1}$ is closed, indicating that the glide effect is suitable for the string timbre. The vibrato effect circuit 34A is provided with a lamp $L_V$. The lamp $L_V$ lights up when a switch $S_{B2}$ linked with a brass timbre selection switch $S_{B1}$ is closed, indicating that the vibrato effect is suitable for the brass timbre.

Connected between the keyer 14 and the timbre filters 20, 22, 24 and 26 is a voltage control type variable gain amplifier VCA40, which produces the touch response circuit 42 through an inhibit gate 44 is superimposed on the voltage signal of a voltage generator 46 and then is fed to the control input VCA40.

The touch response circuit 42 has a touch sensor circuit 48 and a control signal wave shaping circuit 50. The touch sensor circuit 48 detects the speed of key depressing or the depth to which the key is depressed. The control signal wave shaping circuit 50 forms a control signal with a desired control waveform by charging or discharging the capacitor in accordance with the signal from the touch sensor circuit 48. When the touch response effect selection switch $ES_1$ is closed, the control signal from the control signal shaping circuit 50, is fed to the inhibit gate 44 through a resistor $R_{11}$ and a switch $ES_1$. The touch response circuit 42 has a lamp $L_A$, which, when the tone of the harpsichord or piano is selected and the switch $S_{H2}$ or $S_{P2}$ is closed, lights up indicating that the touch response effect is suitable for the sound of the harpsichord or piano.

The inhibit gate 44 is deenergized when the switch $S_{S2}$ is closed by the selection of the stringed instrument timbre and also when the switch $S_{B2}$ is closed by the selection of the metal wind instrument timbre. In other words, when the tone of stringed instruments or metal wind instruments is selected, the control signal cannot be passed through the gate 44 and therefore the touch response effect is blocked.

The voltage generaor 46 comprises a resistor $R_{23}$ and a voltage divider consisting of resistors $R_{21}$ and $R_{22}$. A voltage signal generated by the voltage divider is outputted through the resistor $R_{23}$ to the point SP where it is added to the output from the inhibit gate 44.

The action of VCA40 will be detailed here. When the switch $ES_1$ is open, or when the switch $ES_1$ is closed, but the inhibit gate 44 is deenergized by the selection of the stringed instrument sound or metal wind instrument sound, the VCA40 amplifies the keyed output signals from the keyer 14 by a certain gain according to the voltage signal from the voltage generator 46. When the switch $ES_1$ is closed and the inhibit gate 44 is turned on by the selection of the harpsichord sound or piano sound, the control signal generated by the touch response circuit 42 in response to the key operation is passed through the inhibit gate 44. This control signal is superimposed on the voltage signal from the voltage generator 46 and the supplied to the VCA40. The VCA40 then amplifies the keyed output signal from the keyer 14 by the gain corresponding to the control signal. In other words, the keyed output signal is amplitude-modulated by VCA40 according to the control signal to produce the touch response effect. With the touch response effect applied, the higher the key depressing speed or the greater the key depressing depth, the greater will be the amplitude or volume of sound generated.

Thus, when the touch response effect selection switch $ES_1$ is closed and the sound of stringed instruments or brasses is selected, the inhibit gate 44 will automatically block the touch response effect. When the sound of harpsichord or piano is selected, with this switch closed, the touch response effect is applied to the sound.

Next, the circuit for generating the ensemble effect and tremolo effect will be explained. The sound signal is fed to the effect selection switch $ES_2$ through the piano tone selection switch $S_{P1}$. If the switch $ES_2$ is switched to the contact a, the sound signal is supplied to an output amplifier 28. When connected to the contact b, the switch $ES_2$ supplies the sound signal to an ensemble effect circuit 52. And when connected to the contact c, the switch $ES_2$ supplies the sound signal to a tremolo effect circuit.

The ensemble effect circuit 52 is a modulating circuit in which the input sound signal is supplied to three parallel semiconductor delay elements such as bucket brigade devices and each of the transfer clock signals to these semiconductor delay elements is frequency-modulated by low frequency signals of different phases to apply delay-time modulation to the sound signal. The input sound signal and the output sound signal of the ensemble effect circuit 52 are supplied to the selector circuit 56 as inputs A and B, respectively. The selector 56 functions as follows. When the sound of a harpsichord or piano is selected and the switch $S_{H2}$ or $S_{P2}$ is closed, the selector circuit 56 selects the input A, that is, the input sound signal of the ensemble effect circuit 52 and supplies it to the output amplifier 28. When both of these switches $S_{H2}$ and $S_{P2}$ are open, the input B, that is, the output sound signal of the ensemble effect circuit 52 is selected and fed to the output amplifier 28. Thus, when the sound of a harpsichord or piano is selected, the ensemble effect is automatically blocked even if the effect selection switch $ES_2$ is connected to the contact b.

The ensemble effect circuit 52 has a lamp $L_E$, which, when the timbre of the stringed instruments is selected, lights up as a result of closing of the switch $S_{S2}$, indicating that the ensemble effect is suitable for the tone of the strings.

The tremolo effect circuit 54 comprises a modulating circuit in which the input sound signal is amplitude-modulated with a low frequency signal. The input sound signal and the output sound signal of the tremolo effect circuit 54 are supplied to the selector circuit 58 as the inputs A and B, respectively. When the tone of a harpsichord or piano is selected and the switch $S_{H2}$ or $S_{P2}$ is closed, the selector 58 selects the input A, that is, the input sound signal of the tremolo effect circuit 54 and supplies it to the output amplifier 28. When both of these switches $S_{H2}$ and $S_{P2}$ are open, the input B, that is, the output sound signal of the tremolo effect circuit 54 is supplied to the output amplifier 28. Thus, when the harpsichord or piano sound is selected, the tremolo effect is automatically blocked even if the effect selection switch $ES_2$ is switched to the contact c.

The tremolo effect circuit 54 has a lamp $L_T$, which, when the brass sound is selected and the switch $S_{B2}$ is closed, lights up indicating that the tremolo effect is suitable for the brass timbre.

While in the above embodiment the switches linked with the timbre selection switches are used as a means to detect that a certain timbre has been selected, individual sound signal detecting circuits may be provided for each timbre. The lamps used to indicate the adequacy of the sound effects may be replaced by other kinds of indicators such as those made of light emitting diodes or liquid crystal.

Although a few embodiments of the present invention have been described in the foregoing, it will be obvious to those skilled in the art that various modifications and changes may be made without departing from the spirit and scope of the present invention.

I claim:

1. An electronic musical instrument capable of selecting a timbre applied to a sound produced therefrom comprising:

(a) keyboard means;

(b) means for selecting a desired timbre from among a plurality of timbres;

(c) means for electronically producing the sound with the selected timbre by said selecting means in response to a keyboard means;

(d) means for selectively imparting a plurality of effects to said sound;

(e) means for generating a timbre signal in accordance with said selected timbre; and (f) means for preventing a specific effect or effects among said plurality of effects imparted to said sound in response to said timbre signal from said generating means.

2. An electronic musical instrument according to claim 1, further comprising means responsive to said selecting means for indicating said specific effect or effects which are prevented from being imparted to the sound.

3. An electronic musical instrument according to claim 1 or 2, wherein said selected timbre includes at least one of the timbres of a harpsichord or piano, and said specific effects include at least one of the glide effect, vibrato effect, ensemble effect and tremolo effect.

4. An electronic musical instrument according to claim 1 or 2, wherein said selected timbre includes at least one of the string and brass timbres, and said specific effects include a touch response effect.

5. An electronic musical instrument according to claim 1, further comprising means responsive to said selecting means for indicating predetermined effects which are allowed by said preventing means to be imparted by said imparting means.

6. An electronic musical instrument according to claim 5, wherein said selected timbre includes at least one of the timbres of a harpsichord or piano, and said predetermined effects include a touch response effect.

7. An electronic musical instrument according to claim 5, wherein said selected timbre includes that of string, and said predetermined effects include at least one of the glide effect and the ensemble effect.

8. An electronic musical instrument according to claim 5, wherein said selected timbre includes that of brass, and said predetermined effects include at least one of the vibrato effect and tremolo effect.

9. An electronic musical instrument according to claim 5, further comprising means for selecting from among said predetermined effects at least one effect which is imparted by said imparting means.

* * * * *